US007798539B2

(12) United States Patent
Hayakawa et al.

(10) Patent No.: US 7,798,539 B2
(45) Date of Patent: Sep. 21, 2010

(54) DOOR LOCK DEVICE FOR VEHICLE

(75) Inventors: Shigeru Hayakawa, Chiryu (JP); Ryujiro Akizuki, Kariya (JP); Atsushi Katsurayama, Anjo (JP); Yasuhiko Sono, Hekinan (JP); Satoshi Suzuki, Anjo (JP); Eiji Torii, Nukata-gun (JP); Toshihiro Kitamura, Okazaki (JP)

(73) Assignees: Aisin Seiki Kabushiki Kaisha, Kariya-Shi, Aichi-Ken (JP); Aisin Kiko Co., Ltd., Hazu-Gun, Aichi-Ken (JP)

( * ) Notice: Subject to any disclaimer, the term of this patent is extended or adjusted under 35 U.S.C. 154(b) by 796 days.

(21) Appl. No.: 11/523,045

(22) Filed: Sep. 19, 2006

(65) Prior Publication Data

US 2007/0075552 A1 Apr. 5, 2007

(30) Foreign Application Priority Data

Sep. 30, 2005 (JP) ..... 2005-287991
Nov. 15, 2005 (JP) ..... 2005-330837

(51) Int. Cl.
*E05C 3/06* (2006.01)
*E05C 3/16* (2006.01)

(52) U.S. Cl. ..... 292/216; 292/201

(58) Field of Classification Search ..... 292/201, 292/216

See application file for complete search history.

(56) References Cited

U.S. PATENT DOCUMENTS 4,904,006 A * 2/1990 Hayakawa et al. ..... 292/336.3
5,516,167 A * 5/1996 Hayakawa et al. ..... 292/337
5,531,488 A * 7/1996 Yoshikuwa et al. ..... 292/216

(Continued)

FOREIGN PATENT DOCUMENTS

DE 10116621 A1 10/2001

(Continued)

OTHER PUBLICATIONS

EP Extended Search Report dated Mar. 24, 2010 issued in the corresponding European Patent Application No. 06254891.2-2321.

(Continued)

*Primary Examiner*—Carlos Lugo
(74) *Attorney, Agent, or Firm*—Buchanan Ingersoll & Rooney PC

(57) ABSTRACT

A door lock device for a vehicle includes an operating mechanism being selectable of a locked state where a latched state, between a latching member and a latched member, being unreleasable and an unlocked state where the latched state being releasable, an active lever being rotatable between a locked position and an unlocked position thereof, and an open link disabling a transmission of an operational force of a handle to the latched member under the locked state and allowing a transmission of the operational force of the handle to the latched member under the unlocked state. The active lever, provided with an elongated bore, is supported by a housing which houses the operating mechanism to be rotatable. The open link is operatively connected to the handle to be slidably supported by the housing and is provided with an engaging portion which engages with the elongated bore to be slidable therein.

10 Claims, 9 Drawing Sheets

U.S. PATENT DOCUMENTS

| | | | | |
|---|---|---|---|---|
| 6,406,073 | B1 * | 6/2002 | Watanabe | 292/216 |
| 6,575,506 | B2 | 6/2003 | Hayakawa et al. | |
| 6,679,532 | B2 * | 1/2004 | Inoue | 292/216 |
| 6,951,355 | B2 * | 10/2005 | Hayakawa et al. | 292/201 |
| 7,055,872 | B2 * | 6/2006 | Hayakawa et al. | 292/216 |
| 7,080,861 | B2 * | 7/2006 | Watanabe | 292/216 |
| 2002/0011733 | A1 | 1/2002 | Kunst et al. | |
| 2002/0050720 | A1 | 5/2002 | Helmer | |

FOREIGN PATENT DOCUMENTS

| | | | |
|---|---|---|---|
| EP | 0645511 | A1 | 3/1995 |
| EP | 1191171 | A2 | 3/2002 |
| GB | 2329927 | A | 4/1999 |
| JP | S59-160763 | U | 10/1984 |
| JP | 2001-262903 | A | 9/2001 |
| JP | 2001-262905 | A | 9/2001 |

OTHER PUBLICATIONS

JP Office Action dated Apr. 28, 2010 issued in corresponding Japanese Patent Application and English Translation.

* cited by examiner

DOOR LOCK DEVICE FOR VEHICLE

CROSS REFERENCE TO RELATED APPLICATIONS

This application is based on and claims priority under 35 U.S.C. §119 with respect to Japanese Patent Application No. 2005-287991 filed on Sep. 30, 2005, and Japanese Patent Application No. 2005-330837 filed on Nov. 15, 2005 the entire content of which are incorporated herein by reference.

FIELD OF THE INVENTION

The present invention relates to a door lock device for a vehicle.

BACKGROUND

A known door lock device for a vehicle described in JP2001-262903A (See paragraphs 0024-0027, FIG. 1) includes an operating mechanism which selectively achieves a locked state where a latched state between a latching means (i.e., a striker 45) provided at a body of the vehicle and a latched means (i.e., latch 41 and pawl 42 or the like) provided at a door cannot be released, and an unlocked state where the latched state is releasable.

With the construction of the known door lock device of this kind, the locked state where the latched state between the latch and the striker cannot be released can be achieved by operating a lock knob in the vehicle, and the locked state or the unlocked state of the door lock device is selectable by a rotational operation of a key cylinder by means of a keyblade at outside of the vehicle or by a remote controlled operation of a lock/unlock switch provided at the keyblade at the outside of the vehicle. When the door lock device is at the unlocked state, the door can be opened by operating an inside handle at the vehicle inside or by operating an outside handle at an outside of the vehicle. When the door lock device is at the locked state, the locked state is maintained not to open the door even if the inside handle and/or the outside handle is operated.

With the construction of the known door lock device, as described in JP2001-262903A, regarding a relation between an open link serving as a transmitting member of an opening operation system and an active lever serving as a switching member of a locking system, an engaging projection provided at the active lever is slidably engaged with a elongated bore formed on the open link. With this construction, by operating an open lever, the open link slides so that the engaging projection slides in the elongated bore, and the open link can be moved tilting between the locked state and the unlocked state when the active lever is rotated by operating the key cylinder or by an operation of a remote controller.

With the construction of the known door lock device described in JP2001-262903A, because the elongated bore is provided at the open link which slides, a size of the open link is increased, and an operational range at an opening operation of the open link at the locked state and the unlocked state is increased. Consequently, a housing which houses the operating mechanism of the door lock is increased in size, larger space is required to mount the door lock device, and costs of parts is increased in accordance with the increase in size.

According to another aspect, the known door lock device for the vehicle described in JP2001-262903A includes a drawback that a noise is generated because of a shakiness between an engaging pin 22b and a first engaging groove 23a when a cancel lever 22 and an open link 23 are operated because there is a gap between the engaging pin 22b and the first engaging groove 23a in a construction that the engaging pin 22b is guided by the first engaging groove 23a to connect the cancel lever 22 and the open link 23.

Further, in order to guide the engaging pin 22b of the cancel lever 22, the first engaging groove 23a is necessary to be provided at the open link 23, that is, as shown in FIG. 7 of JP2001-262903A, a portion which forms the first engaging groove 23a (i.e., a portion at a right side and a bottom side of the first engaging groove 23a) is required to be provided in the open link 23. This increases a size of the open link 23, which leads an increase in size and cost of the door lock device for the vehicle.

A need thus exists for a door lock device for a vehicle, which downsizes an open link, a housing, and the device per se, improves a mountability on a vehicle, eliminates a shakiness of the open link and a cancel lever, and reduces a manufacturing cost.

SUMMARY OF THE INVENTION

In light of the foregoing, a door lock device for a vehicle includes an operating mechanism being selectable of a locked state where a latched state, between a latching means provided at a body of the vehicle and a latched means provided at a door, being unreleasable and an unlocked state where the latched state being releasable, an active lever being rotatable between a locked position and an unlocked position thereof, and an open link disabling a transmission of an operational force of a handle, provided at the door, to the latched means under the locked state and allowing a transmission of the operational force of the handle to the latched means under the unlocked state. The active lever, provided with an elongated bore, is supported by a housing which houses the operating mechanism to be rotatable. The open link is operatively connected to the handle to be slidably supported by the housing and is provided with an engaging portion which engages with the elongated bore to be slidable therein.

BRIEF DESCRIPTION OF THE DRAWINGS

The foregoing and additional features and characteristics of the present invention will become more apparent from the following detailed description considered with reference to the accompanying drawings, wherein.

DETAILED DESCRIPTION

One embodiment of the present invention will be explained with reference to illustrations of drawing figures as follows.

Figure 12:
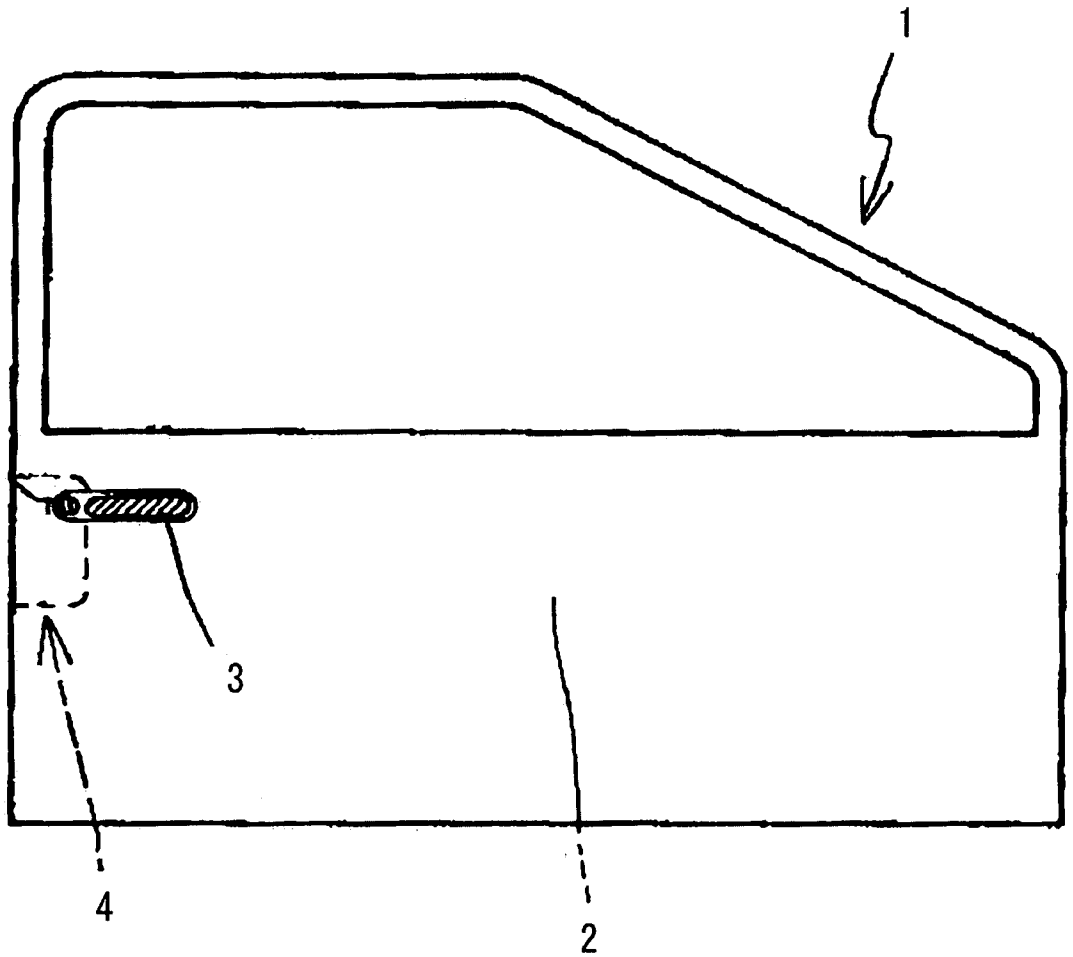
FIG. 12 is an overview showing a vehicle door on which the door lock device is mounted according to the embodiment of the present invention.

As shown in FIG. 12, a door lock device 4 for a vehicle is provided at the inside of a door 2, and includes a housing unit 10 and a sub-base unit 40. The housing unit 10 includes a housing body unit 20 and a cover unit 30.

Figure 1:
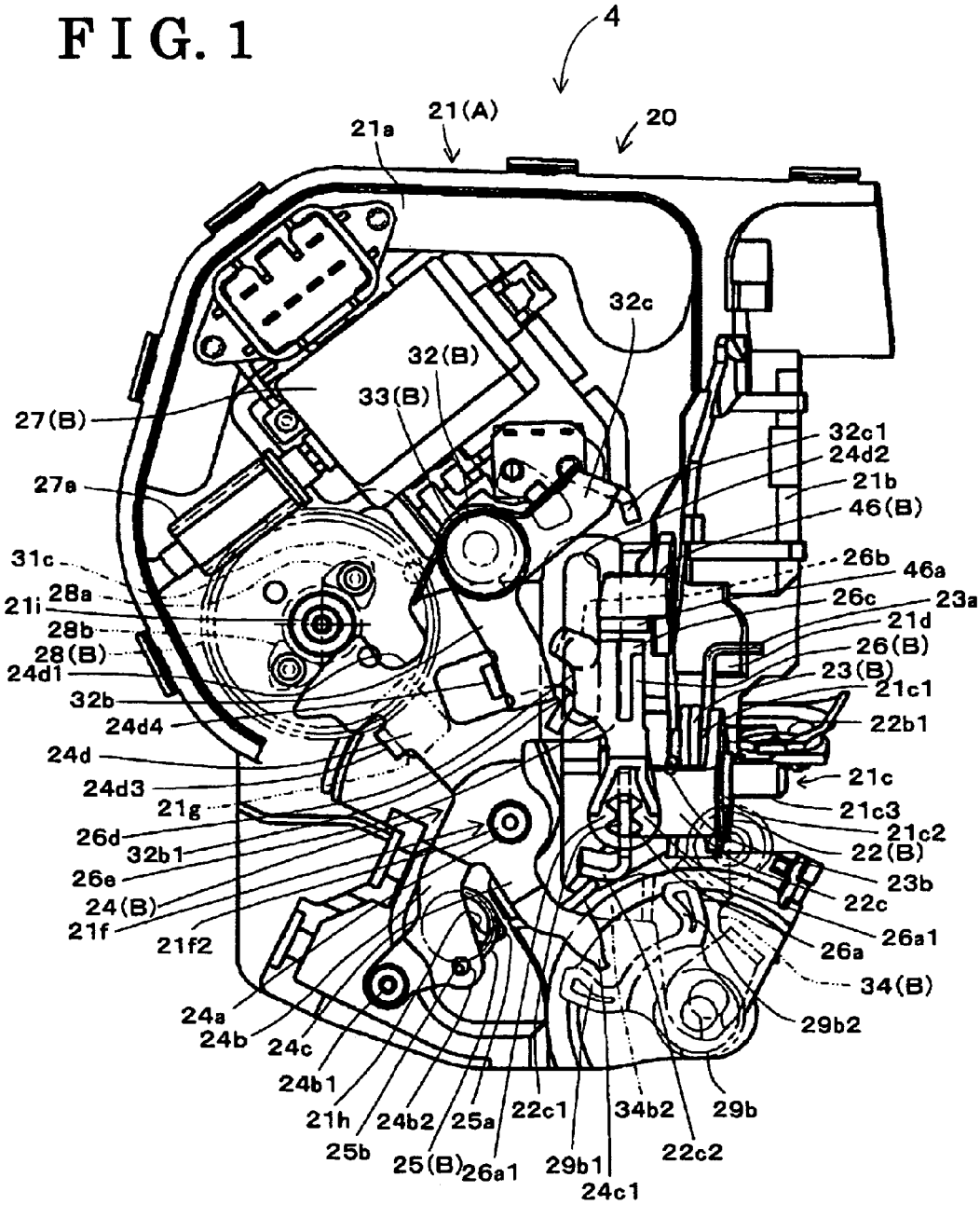
FIG. 1 is a left lateral view basically showing a housing body unit of a door lock device for a vehicle according to an embodiment of the present invention.
Figure 3:
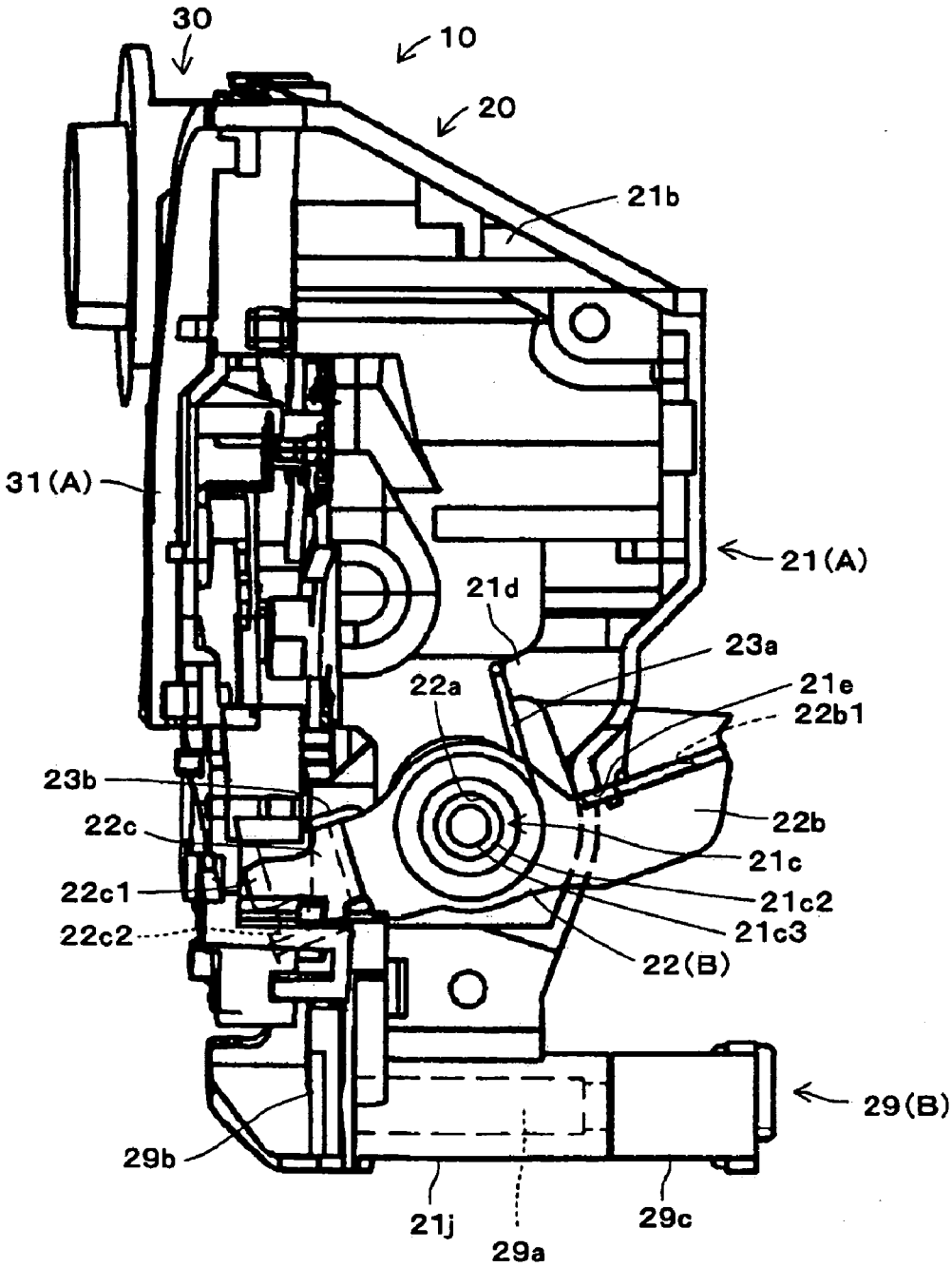
FIG. 3 is a front view showing a housing unit of the door lock device for the vehicle according to the embodiment of the present invention.

As shown in FIGS. 1 and 3, the housing body unit 20 includes a housing body 21. The housing body 21 forms a housing A together with a cover 31 of the cover unit 30 and a sub-base housing 41 of the sub-base unit 40. The housing A is sealed to isolate an operating mechanism B which is housed therein of the door lock device 4 for the vehicle from outside. The operating mechanism B selectively perform a locked state where a latched state of a latch provided at the door 2 and a striker provided at a vehicle body 1 cannot be released and an unlocked state where the latched state can be released. The operating mechanism B includes an open lever 22, a torsion spring 23, an active lever 24, a torsion spring 25, an open link 26, an electric motor 27, a wheel gear 28, an idle lever 29, a cancel lever 32, a torsion spring 33, an inside lever 34, a sub-base plate 42, a base plate 43, a latch 44, a pawl 45, a lift lever 46, and a torsion spring 47.

Figure 2:
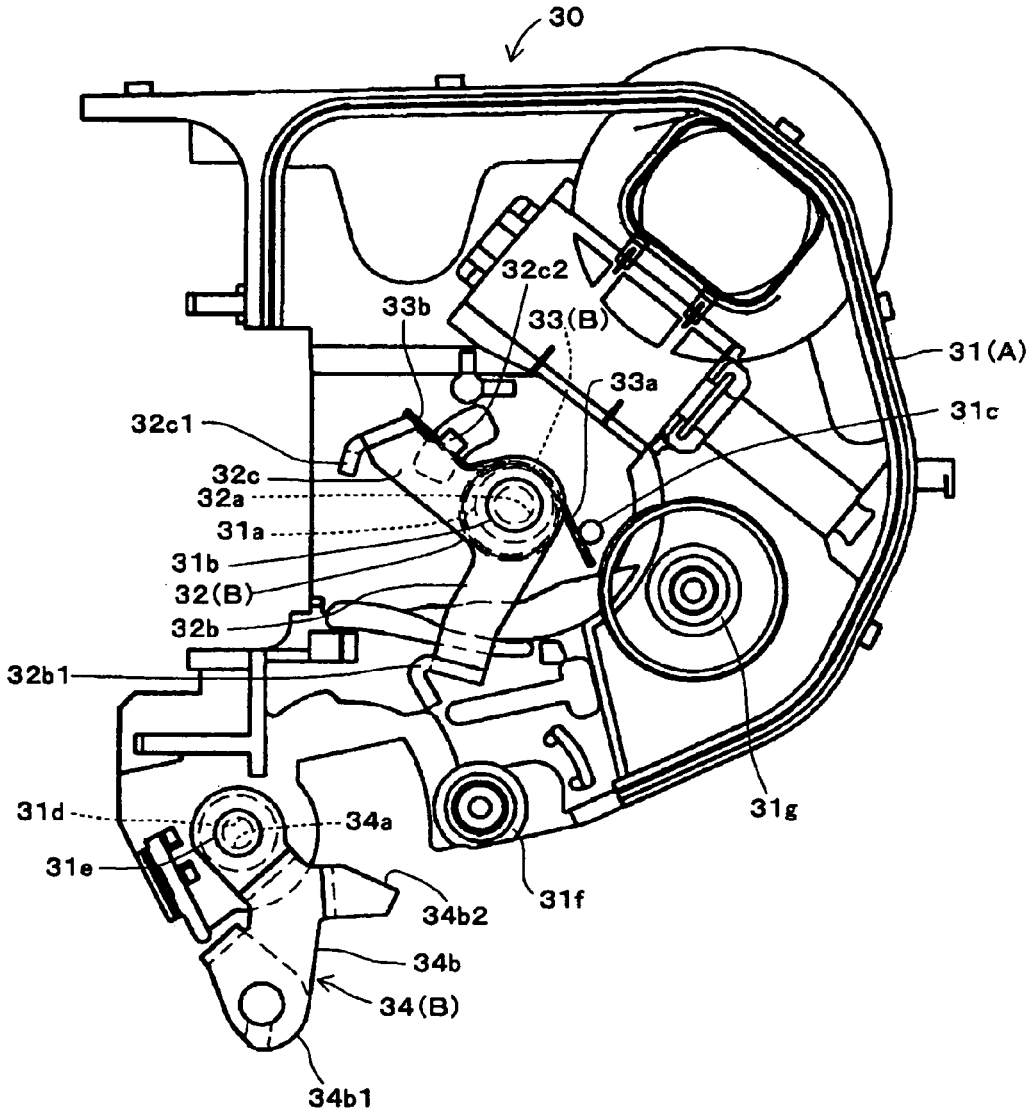
FIG. 2 is a right lateral view showing a cover unit of the door lock device for the vehicle according to the embodiment of the present invention.

The housing body 21 includes a disc-shaped first case portion 21*a* which is extended in a front-back direction (i.e., right, left direction in FIG. 1) of the door 2 and opens to the inside of the door 2 (i.e., perpendicular direction from FIG. 1), and a disc-shaped second case portion 21*b* which is orthogonal to the first case portion 21*a* and opens to a rear side (i.e., to the right in FIG. 1) of the door 2. As shown in FIG. 2, the cover 31 is attached at an opening portion of the first case portion 21*a* and the sub-base housing 41 (shown in FIG. 4) is attached at an opening portion of the second case portion 21*b*. Thus, the opening portion of the first case portion 21*a* is closed by the cover 31 and the opening portion of the second case portion 21*b* is closed by the sub-base housing 41. The sub-base housing 41 also covers an opening at rear side of the cover 31.

The housing body unit 20 includes the open lever 22, the torsion spring 23, the active lever 24, the torsion spring 25, the open link 26, the electric motor 27, the wheel gear 28, and the idle lever 29, which are provided at the housing body 21.

As primarily shown in FIGS. 1 and 3, the open lever 22 is rotatably supported by a stepped boss 21*c* which is integrally formed to be convex on an internal wall surface of the second case 21*b* of the housing body 21. The stepped boss 21*c* is coaxially formed with a large diameter portion 21*c*1, a small diameter portion 21*c*2, and an engaging pin 21*c*3 in order from a base to a tip end. The small diameter 21*c*2 fits into a through-hole 22*a* of the open lever 22. Thus, the open lever 22 is pivotally rotatable about the stepped boss 21*c* as a rotational shaft (fulcrum). A height of the small diameter portion 21*c*2 is determined to be slightly longer than a thickness of the open lever 22, and the open lever 22 is rotatably supported sandwiched between a step provided between the small diameter portion 21*c*2 and the large diameter portion 21*c*1, and the sub-base plate 42.

The open lever 22 includes a first arm 22*b* configured extending in a first direction from the through-hole 22*a* and a second arm 22*c* configured extending in a second direction (i.e., approximately opposite direction to the first arm 22*b*) from the through-hole 22*a*. A handle 3 (i.e., the outside handle) is connected to a connecting hole 22*b*1 formed at a tip end portion (i.e., first end portion) of the first arm 22*b* via a connecting member (e.g., a link). A contact portion 22*c*2 and an engagement supporting portion 22*c*1, which is a projection, are formed on a tip end portion (i.e., second end portion) of the second arm 22*c*. The engagement supporting portion 22*c*1 is engaged with an engaging hole 26*a* of the open link 26 to support the open link 26 to rotate. The contact portion 22*c*2 is detachably in contact with a contact portion 34*b*2 of the inside lever 34.

The open lever 22 is biased by a torsion spring 23 provided between the housing body 21 (i.e., the second case portion 21*b*) and the open lever 22. The torsion spring 23 fits to the large diameter portion 21*c*1 of the stepped boss 21*c*. A first end 23*a* of the torsion spring 23 is connected to a portion 21*d* of an internal peripheral wall surface of the second case portion 21*b* and a second end 23*b* of the torsion spring 23 is connected to the second arm 22*c* of the open lever 22. Consequently, the open lever 22 is biased counterclockwise in FIG. 3. The first arm 22*b* of the open lever 22 biased as foregoing manner contacts a portion 21*e* of the internal periphery wall surface of the second case portion 21*b* so that a counterclockwise rotation of the open lever 22 is restricted, and thus the position of the open lever 22 is determined and maintained at a normal position shown in FIGS. 1 and 3.

Accordingly, a position of the open lever 22 is determined at the normal position by means of a biasing force of the torsion spring 23 at a normal operation during which the handle 3 (i.e., the outside handle) is not operated to open the door 2. On the other hand, a first end portion of the open lever 22 (i.e., a tip end portion of the first arm portion 22*b*) is pushed down so that the open lever 22 rotates clockwise in FIG. 3 against the biasing force of the torsion spring 23 when the handle 3 (i.e., the outside handle) is operated to open the door 2. Consequently, a second end portion of the open lever 22 (i.e., a tip end portion of the second arm 22*c*) is pushed upward to push the open link 26 upward.

The active lever 24 is rotatably supported by a stepped boss 21*f* which is integrally formed on an internal wall surface of the first case portion 21*a* of the housing body 21 to be convex. The stepped boss 21*f* is coaxially formed with a large diameter portion and a small diameter portion 21*f*2 in the order from a base to a tip end thereof. A through-hole 24*a* of the active lever 24 is fitted to the small diameter portion 21*f*2. This construction enables the active lever 24 to rotate about the stepped boss 21*f* as a rotational axis (fulcrum). A height of the small diameter portion 21*f*2 is determined to be slightly longer than a thickness of the active lever 24, and the active lever 24 is rotatably supported sandwiched between a step provided between the small diameter portion 21*f*2 and the large diameter portion, and a top end of a female boss 31*f* which is formed on an internal wall surface of the cover 31 to be convex.

The active lever 24 includes a first arm 24*b* configured extending in a first direction outward of the first case portion 21*a* from the through-hole 24*a*, a second arm 24*c* configured extending in a second direction outward of the first case portion 21*a* from the through-hole 24*a*, and a third arm 24*d* configured extending in a third direction (i.e., approximately in an opposite direction from the first and second directions) from the through-hole 24*a*. A connecting hole 24*b*1 formed at a tip end portion of the first arm 24*b* is connected to a lock knob provided at an inside of the door 2 via a connecting member (e.g., cable). When the locking operation applied to the lock knob, the active lever 24 rotates counterclockwise. On the other hand, when the unlocking operation is applied to the lock knob, the active lever 24 rotates clockwise.

A contact portion 24*c*1 is formed at a tip end portion of the second arm 24*c*. A pair of contact walls 29*b*1, 29*b*2 provided at an idle lever portion 29*b* of the idle lever 29 which rotates in accordance with a rotational operation of a key cylinder detachably contacts the contact portion 24*c*1. When the locking operation is applied to the key cylinder, the idle lever portion 29*b* is rotated clockwise thus to rotate the active lever 24 counterclockwise. On the other hand, when the unlocking operation is applied to the key cylinder, the idle lever portion 29*b* is rotated counterclockwise thus to rotate the active lever 24 clockwise.

The third arm 24*d* is formed in approximately fan shape, and an external periphery of the third arm 24*d* is formed approximately in arc shape which has the center at an axial center of the through-hole 24*a*. An engaging recess portion 24*d*1 is formed at an external peripheral rim portion of the third arm 24*d*. The engaging recess portion 24*d*1 is selectively engaged with a first engaging pin 28*a* and a second engaging pin 28*b* which are provided at the wheel gear 28 which is selectively rotated in a normal direction or a reverse direction by an electric motor 27. When the locking operation is conducted by the electric motor 27, the wheel gear 28 is rotated clockwise to rotate the active lever 24 counterclockwise. On the other hand, when the unlocking operation is conducted by the electric motor 27, the wheel gear 28 is rotated counterclockwise to rotate the active lever 24 clockwise.

An elongated bore 24*d*2 which extends approximately in a direction of the through-hole 24*a* is formed at a first side of the third arm 24*d*. The elongated bore 24*d*2 is slidably engaged with an engaging portion 26*b* of the open link 26.

A first and second engaging projections 24*d*3, 24*d*4 are provided at the third arm 24*d* between the through-hole 24*a* and an external peripheral rim portion of the third arm 24*d*. The first engaging projection 24*d*3 contacts a blocking member 21*g* provided on an internal wall surface of the first case portion 21*a* to restrict clockwise rotation of the active lever 24. The second engaging projection 24*d*4 contacts the blocking member 21*g* to restrict counterclockwise rotation of the active lever 24.

The active lever 24 is biased by a torsion spring 25 provided between the housing body 21 (i.e., the first case portion 21*a*) and the active lever 24. A first end 25*a* of the torsion spring 25 is connected with a connection hole 21*h* provided at an internal wall surface of the first case portion 21*a*. A second end 25*b* of the torsion spring 25 is connected with a connection hole 24*b*2 provided at the first arm 24*b* of the active lever 24.

When the active lever 24 is at an unlocked position (primarily shown in FIGS. 1 and 6), the active lever 24 is biased clockwise by the torsion spring 25. In those circumstances, upon contacting the first engaging projection 24*d*3 with the blocking member 21*g* to restrict the clockwise rotation thereof, the position of the active lever 24 is determined and maintained at the unlocked position shown in FIG. 1. When the active lever is positioned at a locked position (primarily shown in FIGS. 8 and 9), the active lever 24 is biased counterclockwise by the torsion spring 25. In those circumstances, upon contacting the second engaging projection 24*d*4 with the blocking member 21*g* to restrict counterclockwise rotation thereof, the position of the active lever 24 is determined and maintained at the locked position (shown in FIGS. 8 and 9).

Figure 8:
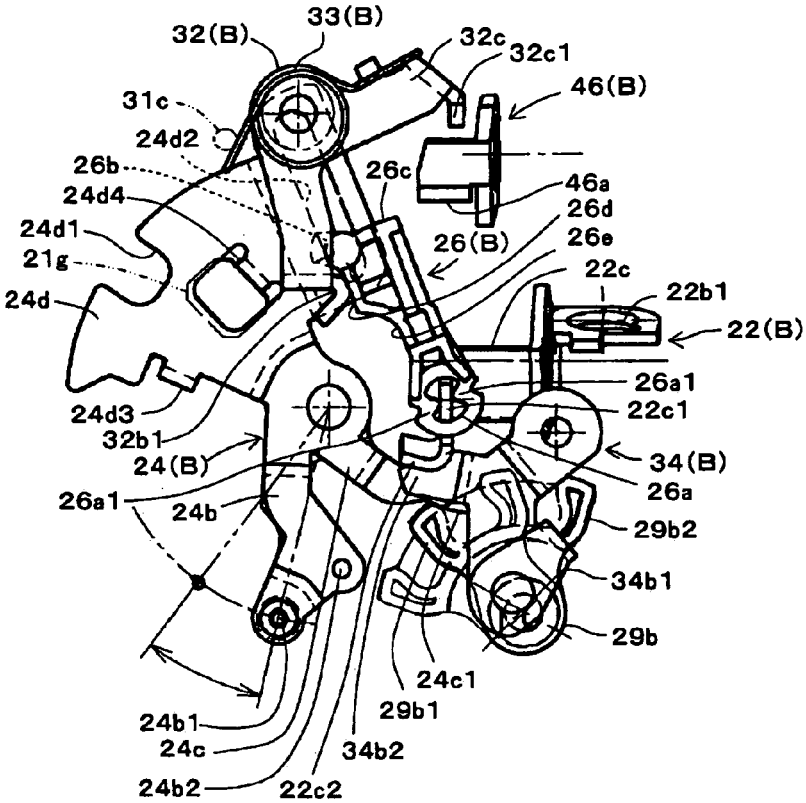
FIG. 8 is a lateral view showing an operational state of each member at a locked state of the door lock device for the vehicle according to the embodiment of the present invention.

Accordingly, the active lever 24 positioned and locked at the unlocked position shown in FIG. 1 is rotated counterclockwise to be positioned and locked at the locked position shown in FIG. 8 when an locking operation is applied to the lock knob or the key cylinder, or when the locking operation is conducted by the electric motor 27. To the contrary, the active lever 24 which is positioned and locked at the locked position is rotated clockwise to be positioned and locked at the unlocked position when an unlocking operation is applied to the lock knob or the key cylinder or when unlocking operation is conducted by the electric motor 27.

The open link 26 is formed approximately in bar shape and is supported at two points by the open lever 22 and the active lever 24. The open link 26 is arranged between the active lever 24 and the cover 31 (in right, left direction shown win FIG. 3), slidably contacts the active lever 24, and slidably guided by an internal wall surface of the cover 31. An engaging hole 26*a* is formed at a first end (i.e., bottom end) of the open link 26. The engagement supporting portion 22*c*1 of the open lever 22 is engaged with the engaging hole 26*a*. An engaging portion 26*b* formed with an engaging pin is formed at a second end (i.e., top end) of the open link 26. The engaging portion 26*b* slidably engages with the elongated bore 24*d*2 of the active lever 24. The open link 26 is at an upright state (i.e., unlocked state) when the active lever 24 is positioned at the unlocked position shown in FIG. 1. The open link 26 is at a tilted state (i.e., locked state) when the active lever 24 is at the locked position shown in FIG. 8. The open link 26 is configured not to transmit an operational force of the handle 3 (i.e., the outside handle or the inside handle) provided at the door 2 to the pawl 45 at the locked state. The open link 26 is configured to transmit an operational force of handle 3 (i.e., the outside handle or the inside handle) at the unlocked state.

A contact portion 26*c* is formed at the second end (i.e., top end) of the open link 26. When the open link 26 is at the upright state, the contact portion 26*c* is moved upward to contact a contact portion 46*a* of the lift lever 46 to rotate the lift lever 46 (i.e., push the contact portion 46*a* upward). When the open link 26 is at the tilted state, the contact portion 26*c* does not contact the contact portion 46*a* of the lift lever 46 even if being moved upward.

The open link 26 includes a first side surface to which the cancel lever 32 contacts. A contact portion 32*b*1 of the cancel lever 32 contacts the first side surface 26*d* of the open link 26 by a biasing force of the torsion spring 33. Thus, because the open link 26 is pushed towards an opposite side (i.e., to the right in FIG. 1) relative to the first side surface 26*d* by the cancel lever 32, the engaging hole 26*a* of the open link 26 engages with the engagement supporting portion 22*c*1 of the open lever 22 without shakiness and the engaging portion 26*b* of the open link 26 engages with the elongated bore 24*d*2 of the active lever 24 without shakiness (i.e., an engaging portion of an open link fittingly engages with an elongated bore of an active lever).

Figure 7:
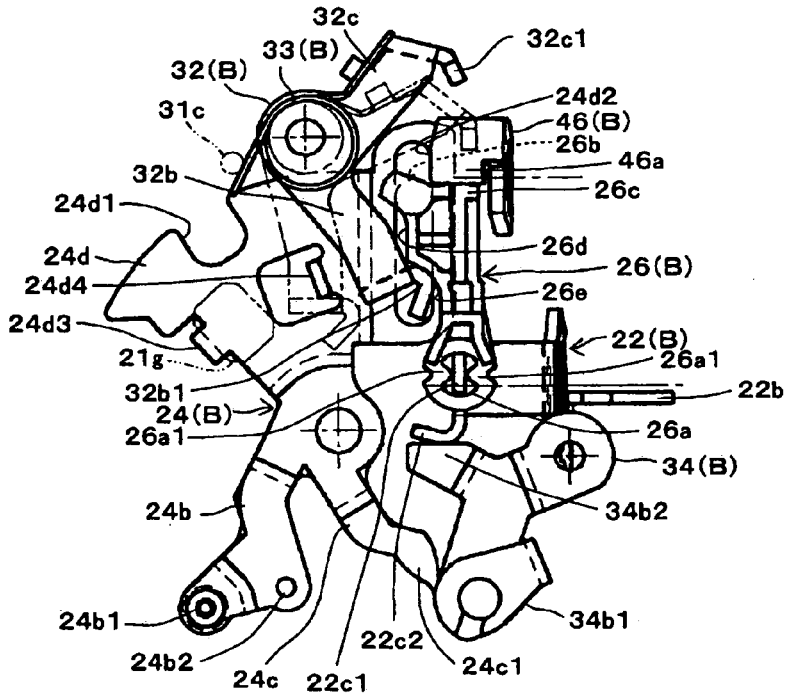
FIG. 7 is a lateral view showing an operational state of each member by operating an inside handle at an unlocked state of the door lock device for the vehicle according to the embodiment of the present invention.
Figure 10:
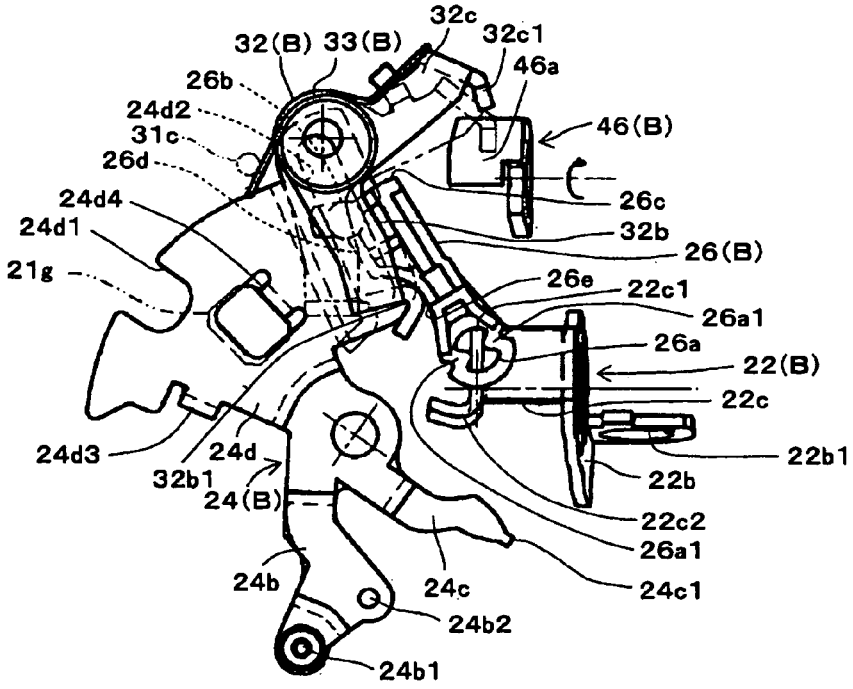
FIG. 10 is a lateral view showing an operational state of each member by a key-less locking operation of the door lock device for the vehicle according to the embodiment of the present invention.

A recess portion 26*e* is provided at the first side surface 26*d* of the open link 26. As shown in FIGS. 7 and 10, the recess portion 26*e* is formed at a portion to which the contact portion 32*b*1 of the cancel lever 32 contacts at an open state of the handle 3 (i.e., the outside handle or the inside handle). In other words, when the open link 26 is pushed upward, the contact portion 32*b*1 of the cancel lever 32 moves (i.e., rotates) in accordance with a configuration of the first side surface 26*d* of the open link 26. Particularly, when the recess portion 26*e* of the first side surface 26*d* reaches the contact portion 32*b*1, the cancel lever 32 rotates counterclockwise and the contact portion 32*c*1 of the cancel lever 32 is detached from the lift lever 46. Accordingly, in those circumstances, even if the open link 26 is pushed upward, interference of the contact portion 46*a* of the lift lever 46 with the contact portion 32*c*1 of the cancel lever 32 can be prevented.

The engaging hole 26*a* of the open link 26 is formed approximately in guitar-like shape, a pair of projections 26*a*1, 26*a*1 which support the engaging projection 22*c* from the both sides, and the engaging hole 26*a* is formed slightly larger than a width of the engagement supporting portion 22*c*1. With the foregoing constructions, irrespective of states of the open link 26 (i.e., either the tilted state or the upright state), a gap between the engaging hole 26*a* of the engagement supporting portion 22*c*1 can be controlled to be as small as possible to securely support the open link 26.

The electric motor 27 is attached on an internal wall surface of the first case portion 21*a* of the housing body 21. The electric motor 27 includes a worm 27*a* at an output shaft, and the worm 27*a* is geared with the wheel gear 28. The wheel gear 28 is rotatably supported by a support boss 21*i* integrally formed with the internal wall surface of the first case portion 21*a*. The support boss 21*i* fits to a female boss 31*g* which is convexly provided on an internal wall surface of the cover 31 to support the wheel gear 28. The active lever 24 is arranged between the wheel gear 28 and the internal wall surface of the first case portion 21*a*. The wheel gear 28 is arranged so as to overlap the active lever 24.

The first and second engaging pins 28*a*, 28*b* are convexly provided at a first side surface (i.e., a side surface which faces the internal wall surface of the first case portion 21*a*) of the wheel gear 28. The first and second engaging pins 28*a*, 28*b* are arranged on the identical line through the rotational center of the wheel gear 28, and sandwiching the rotational center and keeping a predetermined distance form each other. One of the first and the second engaging pins 28*a*, 28*b* contacts an external periphery of the third arm 24*d* and the other of the first and second engaging pins 28*a*, 28*b* faces the engaging recess portion 24*d*1 of the active lever 24.

When the lock operation is performed by the electric motor 27, the electric motor 27 is actuated and the wheel gear 28 at a state shown in FIG. 1 is rotated clockwise. In this case, the first engaging pin 28*a* which faces the engaging recess portion 24*d*1 enters the engaging recess portion 24*d*1 to be engaged therewith, and the active lever 24 is rotated counterclockwise in accordance with the rotation of the wheel gear 28. Thereafter, when the second engaging pin 28*b* contacts the external periphery (i.e., external periphery at the right side of the engaging recess portion 24*d*1) of the third arm 24*d* and the first engaging pin 28*a* is retracted from the engaging recess portion 24*d*1, the activation of the electric motor 27 is stopped and the actuation of the wheel gear 28 is stopped, and the active lever 24 is positioned and locked at the locked position. On the other hand, when the unlock operation is performed by the electric motor 27, by the reverse operation of the foregoing locking operation, the wheel gear 28 is rotated counterclockwise to rotate the active lever 24 clockwise. Then, the wheel gear 28 is stopped at the position shown in FIG. 1 and the position of the active lever 24 is determined and maintained at the unlocked position.

The idle lever 29 is, as primarily shown in FIG. 3, rotatably mounted on a cylindrical supporting portion 21*j* vertically provided outward (i.e., in an extending direction of the second case portion 21*b*) from the internal wall of the first case portion 21*a* of the housing body 21. The idle lever 29 includes a shaft portion 29*a* which is pivotally supported by the supporting portion 21*j*, an idle lever portion 29*b* integrally formed with a first end of the shaft portion 29*a*, and a connecting lever portion 29*c* which is integrally formed with a second end of the shaft portion 29*a*.

As shown in FIG. 1, the idle lever portion 29*b* is configured in fan shape, and rotates about a rotational axis identical to the rotational axis of the shaft portion 29*a*. A pair of contact walls 29*b*1, 2*b*2 are formed at first and second ends of the idle lever portion 29*b* respectively. The contact portion 24*c*1 formed at the second arm 24*c* of the active lever 24 is arranged between the contact walls 29*b*1 and 29*b*2 to be loosely fitted therebetween. The connecting lever portion 29*c* is configured to project vertically downward of FIG. 3 and rotates about a rotational axis identical to the rotational axis of the shaft portion 29*a*. A tip end portion of the connecting lever 29*c* is connected to a key cylinder provided at the handle 3 (i.e., the outside handle) which is provided outward of the door 2 via a connecting member such as a link.

When the locking operation is applied to the key cylinder, the connecting lever portion 29*c* rotates clockwise to rotate the idle lever 29*b* at a state shown in FIG. 1 clockwise. In those circumstances, the contact wall 29*b*1 of the idle lever 29*b* contacts the contact portion 24*c*1 formed at the second arm 24*c* of the active lever 24, and the active lever 24 rotates counterclockwise in accordance with a rotation of the idle lever portion 29*b*. Accordingly, the active lever 24 is positioned and locked at the locked position. On the other hand, when the unlocking operation is applied to the key cylinder, the idle lever portion 29*b* rotates counterclockwise by the reverse operation of the foregoing locking operation, and the active lever 24 rotates clockwise by the force from the contact wall 29*b*2 of the idle lever 29*b*. Accordingly, the active lever 24 is positioned and locked at the unlocked position (i.e., the position shown in FIG. 1).

The cover unit 30, as primarily shown in FIG. 2, is provided at the cover 31. The cover unit 30 includes the cancel lever 32, the torsion spring 33, and the inside lever 34.

The cancel lever 32 is rotatably supported by an attaching pin 31*b* fitted at a through-hole of a pivotally supporting boss 31*a* provided at the internal wall surface of the cover 31. The cancel lever 32 is formed in a bend shape and includes a first arm 32*b* configured extending in a first direction from a through-hole 32*a* provided at a bent portion and a second arm 32*c* configured extending in a second direction from the through-hole 32*a*. The contact portion 32*b*1 (i.e., serving as a first contacting end portion) and the contact portion 32*c*1 (i.e., serving as a second contacting end portion) are formed at each tip end portion of the first arm 32*b* and the second arm 32*c* respectively. The contact portion 32*b*1 contacts the first side surface 26*d* of the open link 26. The contact portion 32*c*1 detachably contacts the contact portion 46*a* of the lift lever 46. An operational force from the pawl 45 (i.e., serving as a latched means) affects the open link 26 by means of the cancel lever 32 to change a state of the open link 46 from the locked state to the unlocked state.

The cancel lever 32 is biased by the torsion spring 33 which is provided between the cover 31 and the cancel lever 32. The torsion spring 33 fits to the pivotally supporting boss 31*a*. A first end 33*a* of the torsion spring 33 is connected with a connecting pin 31*c* vertically provided on the internal wall surface of the cover 31, and a second end 33*b* of the torsion spring 33 is connected with a connecting projection 32*c*2 provided at the second arm 32*c* of the cancel lever 32. Thus, the cancel lever 32 is biased clockwise in FIG. 2 (i.e., counterclockwise in FIG. 1), and the contact portion 32*b*1 of the first arm 32*b* of the cancel lever 32 is biased in a predetermined direction (i.e., to the left in FIG. 2, to the right in FIG. 1). Further, the contact portion 32*b*1 constantly contacts the first side surface 26*d* of the open link 26 by the biasing force of the torsion spring 33 so that the contact portion 32*b*1 constantly pushes the first side surface 26*d* of the open link 26 in the predetermined direction.

The inside lever 34 is provided with a through-hole 34*a*, and the through-hole 34*a* is fitted to an attaching pin 31*e* fitted at a through-hole 31*d* provided at the internal wall of the cover 31 to rotatably support the inside lever 34. The inside lever 34 includes an arm 34*b* configured extending in a first direction from the through-hole 34*a*. A connecting portion 34*b*1 and a contact portion 34*b*2 are formed at a tip end portion and an intermediate portion of the arm 24*b* respectively. The handle 3 (i.e., the inside handle) provided at interior side of the door 2 is connected to the connecting portion 34*b*1 via a connecting member such as a link and a cable. The contact portion 34*b*2 detachably contacts the contact portion 22*c*2 of the open lever 22.

A position of the inside lever 34 is determined at a normal position shown in FIG. 2 (i.e., shown with two dotted line in FIG. 1) by being connected to the connecting member at a normal state at which handle 3 (i.e., the inside handle) is not operated to open the door 2. On the other hand, the inside lever 34 is rotated clockwise in FIG. 1, and the contact portion 34*b*2 contacts the contact portion 22*c*2 of the open lever 22 at the operation where the handle 3 (i.e., the inside handle) is operated to open the door 2. Thereafter, a tip end portion of the second arm 22*c* of the open lever 22 is pushed upward to rotate clockwise in FIG. 3 against the biasing force of the torsion spring 23. Upon closing operation by the handle 3 (i.e., the inside handle), the open lever 22 and the inside lever 34 return to the original position by the biasing force of the torsion spring 23.

Figure 4:
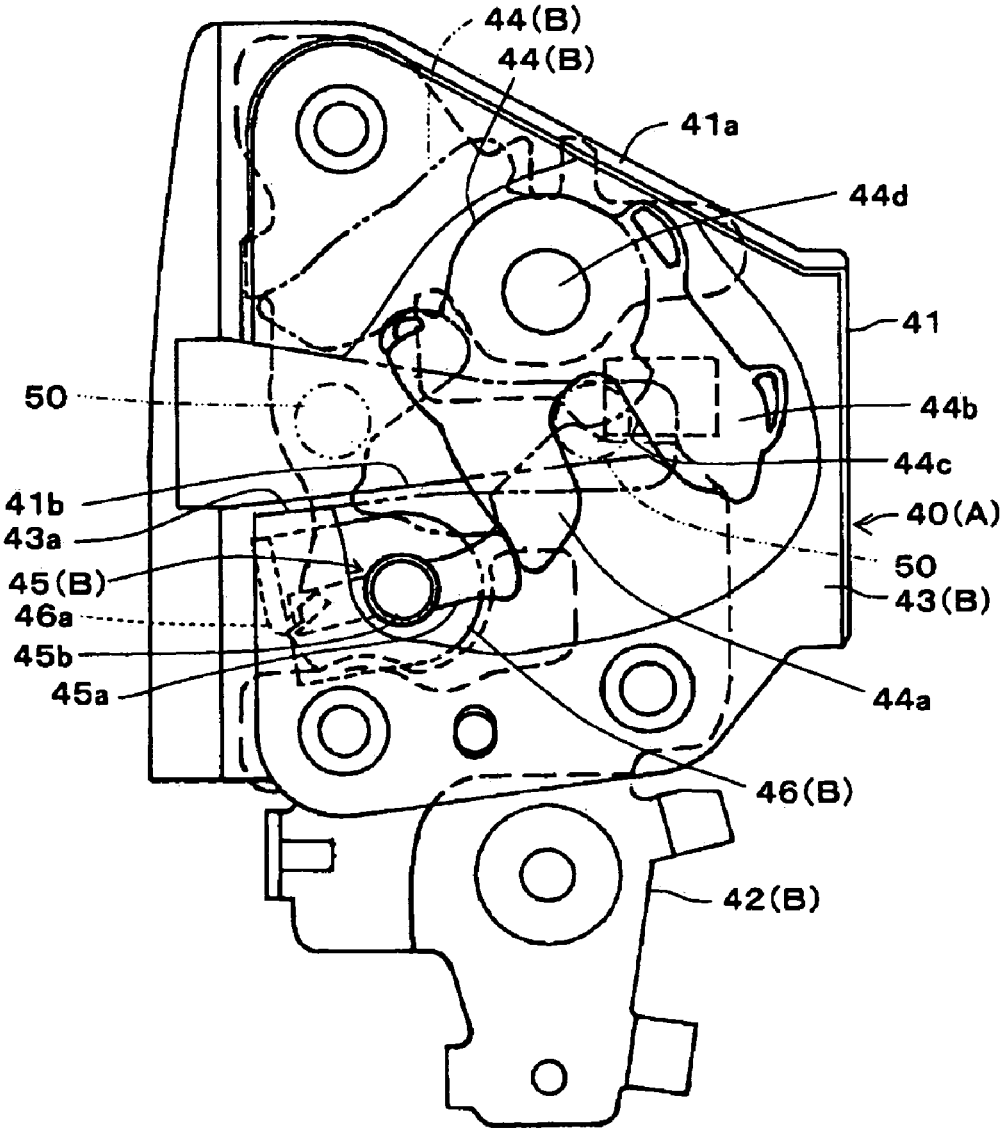
FIG. 4 is a front view showing a sub-base unit of the door lock device for the vehicle according to the embodiment of the present invention.
Figure 5:
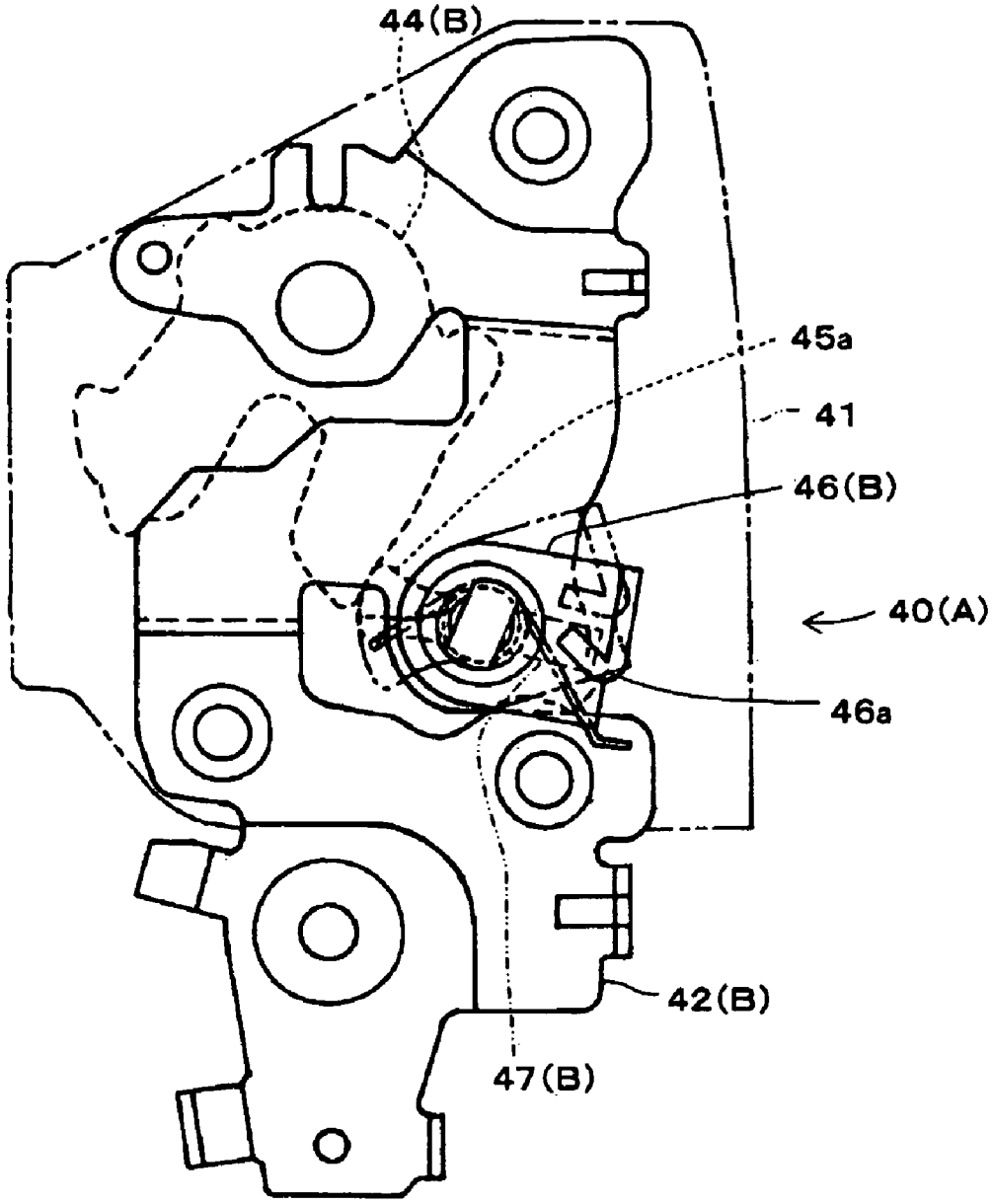
FIG. 5 is a rear view showing the sub-base unit of the door lock device for the vehicle according to the embodiment of the present invention.

The sub-base unit 40, as shown in FIGS. 4 and 5, is provided at the sub-base housing 41. The sub-base unit 40 includes the sub-base plate 42, the base plate 43, the latch 44, the pawl 45, the lift lever 46, and the torsion spring 47.

The sub-base plate 42 and the base plate 43 are attached on a rear side wall 41*a* of the sub-base housing 41, sandwiching from inside and outside. A groove 41*b*, which a striker (i.e. serving as a latching means) 50 provided at the vehicle body 1 selectively enters into and retracted from, is formed on the sub-base housing 41. A groove 43*a*, which the striker 50 selectively enters into and retracted from, is formed on the base plate 43. Recess portions are formed at outside wall of the rear side wall 41*a* of the sub-base housing 41 throughout a top portion and a bottom portion of the groove 41*b*. The latch 44 is housed in the top recess portion, and the pawl 45 is housed in the bottom recess portion. Namely, the latch 44 and the pawl 45 are arranged between the housing 41 (i.e., rear side wall 41*a*) and the sub-base plate 42.

The latch 44 is formed approximately in U shape and includes a pair of projections 44*a*, 44*b* and an opening portion 44*c* formed between the projections 44*a* and 44*b* and which the striker 50 selectively enters into and retracted from. The latch 44 is rotatably supported by a supporting pin 44*d* mounted at the sub-base plate 42 and the base plate 43, penetrating through the sub-base housing 41. The latch 44 is biased clockwise in FIG. 4 by a torsion spring. When the door 2 is open, the latch 44 is positioned and locked at a position shown with two-dotted line in FIG. 4 by the biasing force of the torsion spring. In this case, the opening portion 44*c* of the latch 44 matches to the groove 41*b* of the base housing 41.

The pawl 45 includes a connecting portion 45*a* having a block shape and a shaft portion 45*b* which extends approximately orthogonal to the connecting portion 45*a*. The shaft portion 45*b* is rotatably provided between the sub-base plate 42 and the base plate 43 penetrating through the sub-base housing 41. A torsion spring 47 is fitted at an intermediate portion between the sub-base plate 42 and the sub-base housing 41 at an external periphery of the shaft portion 45*b* of the pawl 45. A first end of the torsion spring 47 is connected to the connecting portion 45*a* of the pawl 45, and a second end of the torsion spring 47 is connected to the sub-base plate 42. The pawl 45 is biased counterclockwise in FIG. 4 (i.e., clockwise in FIG. 5) by the biasing force of the torsion spring 47. A counterclockwise rotation of the pawl 45 which is biased in the foregoing manner is restricted by a restricting member to be positioned and locked at a normal position shown in FIG. 4.

The lift lever 46 is integrally rotatably fitted to the shaft portion 45*b* of the pawl 45 at opposite end of the connecting portion 45*a*. The contact portion 46*a* is formed at a tip end portion of the lift lever 46. The contact portion 46*a* detachably contacts the contact portion 26*c* of the open link 26. Because the lift lever 46*a* integrally rotates to the pawl 45, the lift lever 46 is biased counterclockwise in FIG. 4 (i.e., clockwise in FIG. 5) by the biasing force of the torsion spring 47. Further, a counterclockwise rotation of the lift lever 46 is restricted by restricting counterclockwise rotation of the connecting portion 45*a* by a restricting member, and the lift lever 46 is positioned and locked at a normal position shown with a solid line in FIG. 5.

When the door 2 is open, the latch 44 is positioned and locked at a position shown with two dotted chain line in FIG. 4 by means of the biasing force of the torsion spring. When closing the open door 2, the striker 50 which relatively enters the opening portion 44*c* of the latch 44 along the groove 41*b* of the base housing 41 contacts an internal wall surface of the projection 44*b* of the latch 44, and the latch 44 rotates counterclockwise against the biasing force of the torsion spring. Meanwhile, the connecting portion 45*a* of the pawl 45 is pushed downward by the projection 44*a* or 44*b*, and the pawl 45 is rotated clockwise against the biasing force. Eventually, the latch 44 rotates to the position shown with a solid line in FIG. 4, and is positioned and locked by locking the projection 44*a* of the latch 44 not to turn clockwise in FIG. 4 by the connecting portion 45*a* of the pawl 45. Consequently, a latched state at which the striker 50 and the latch 44 are latched is maintained. The latch 44 and the pawl 45 serve as a latched means.

When the door 2 is operated to open at the latched state, the lift lever 46 is rotated clockwise in FIG. 4 and the pawl 45 rotates in the same direction accordingly, and the connecting portion 45*a* of the pawl 45 is disengaged from the projection 44*a* of the latch 44. In those circumstances, the latch 44 rotates to return to the position shown with the two-dotted chain line in FIG. 4 by the biasing force of the torsion spring, and the opening portion 44*c* of the latch 44 matches to the groove 41*b* of the base housing 41. In the foregoing circumstances, the striker 50 is retractable from the opening portion 44*c* of the latch 44 and the groove 41*b* of the base housing 41. Accordingly, the latched state at which the striker 50 and the latch 44 are latched is released.

Referring to FIGS. 6-11, an operation of a door lock device 4 for a vehicle will be explained. First, a case when opening operation of the door 2 is performed at a non-operating state at which the door lock device 4 for the vehicle is at the unlocked state shown in FIG. 6 and opening operation of the door 2 is not performed will be explained with reference to FIG. 7. With the door lock device 4 for the vehicle at non-operating state of door 2 and at the unlocked state shown in FIG. 6, likewise a state shown in FIG. 1, the position of the open lever 22 is determined and maintained at a normal position, the position of the active lever 24 is determined and maintained at the unlocked state, and the open link 26 which is supported by the open lever 22 and the active lever 24 is positioned upright. The cancel lever 32 is pushed by the biasing force of the torsion spring 33 to be positioned and locked at a state contacting the first side surface 26*d* of the open link 26. The lift lever 46 is positioned and locked at the normal position.

When the opening operation of the handle 3 (i.e., the outside handle) is performed under the foregoing state, as shown in FIG. 7, the open lever 22 positioned at the normal position is rotated against the biasing force of the torsion spring 23, and the tip end portion of the second arm 22*c* moves upward. Accordingly, the open link 26 is pushed upward maintaining an upright state. Thereafter, the contact portion 26*c* of the open link 26 pushes the contact portion 46*a* to move the lift lever 46 positioned at the normal position, and the lift lever 46 is rotated against the biasing force of the torsions spring 47. Consequently, the connecting portion 45*a* of the pawl 45 positioned at the normal position is rotated. In this case, in case the connecting portion 45*a* is engaged with the latch 44, the latch 44 is disengaged from the connecting portion 45*a*, and the latched state at which the striker 50 and the latch 44 can be released.

In this case, with a relation between the open link 26 and the cancel lever 32, because the open link 26 is pushed towards the opposite side (i.e., to the right in FIG. 7) of the first side surface 26*d* by the cancel lever 32, the engaging hole 26*a* of the open link 26 engages with the engagement supporting portion 22*c*1 of the open lever 22 without shakiness and the engaging portion 26*b* of the open link 26 slides along the elongated bore 24*d*2 of the active lever 24 without shakiness. When the open link 26 is pushed upward and the recess portion 26*e* of the first side surface 26*d* reaches the contact portion 32*b*1, the cancel lever 32 rotates counterclockwise, and the contact portion 32*c*1 of the cancel lever 32 is detached from the lift lever 42. Accordingly, even when the open link 26 is pushed upward, the interference of the contact portion 46*a* of the lift lever 46 pushed upward by the open link 26 with the contact portion 32*c*1 of the cancel lever 32 can be prevented.

When opening operation of the handle 3 (i.e., the inside handle) is performed, the inside lever 34 positioned at the normal position is rotated clockwise in FIG. 7, and the contact portion 34*b*2 contacts the contact portion 22*c*2 of the open lever 22. Then, the tip end portion of the second arm 22*c* of the open lever 22 is pushed upward. Thereafter, the operation likewise the opening operation of the handle 3 (i.e., the outside handle) is performed.

Figure 6:
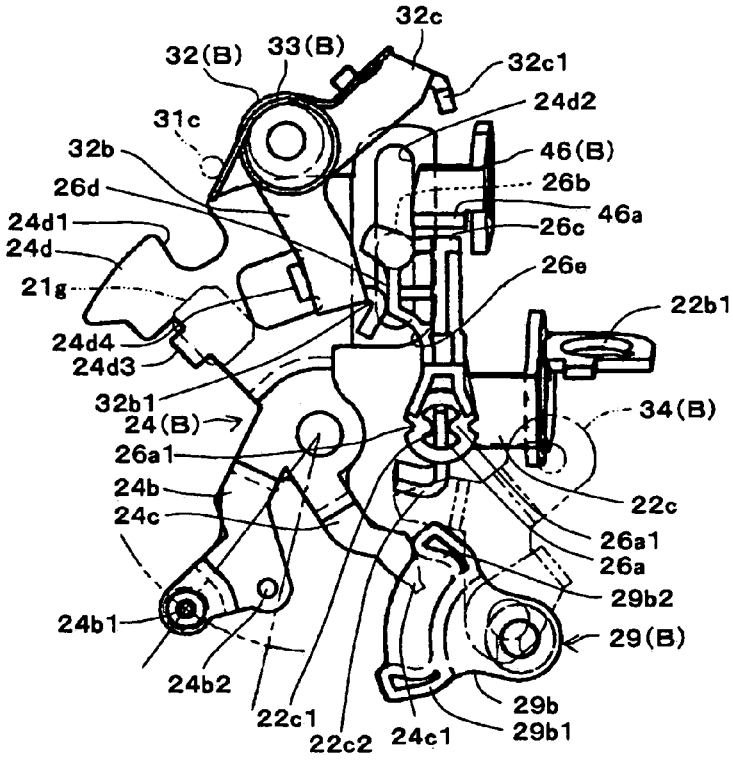
FIG. 6 is a lateral view showing an operational state of each member at an unlocked state of the door lock device for the vehicle according to the embodiment of the present invention.

Next, when the locking operation is performed with the door lock device 4 for the vehicle which is under the unlocked state and at non-operating state of door 2 with reference to FIG. 8. When the locking operation is applied to the lock knob or the key cylinder, or when the locking operation is performed by the electric motor 27, the active lever 24 positioned and locked at the unlocked position shown in FIG. 6 is rotated counterclockwise. Then, the second connecting projection 24*d*4 contacts the blocking member 21*g* to restrict the counterclockwise rotation, and the active lever 24 is positioned and locked at the locked position shown in FIG. 8. Consequently, the open link 26 at the upright state becomes the tilted state. Further, the cancel lever 32 which contacts the open link 26 is rotated clockwise against the biasing force of the torsion spring 33, and the contact portion 32*c*1 of the cancel lever 32 moves to the position approaching the contact portion 46*a* of the lift lever 46. At the position, the contact portion 46*a* of the lift lever 46 can contact the contact portion 32*c*1 of the cancel lever 32.

When the locking operation is applied to the key cylinder, a first key lever is rotated clockwise and the idle lever portion 29*b* which is at a state shown in FIG. 1 is rotated clockwise. Accordingly, the contact wall 29*b*1 of the idle lever portion 29*b* contacts the contact portion 24*c*1 formed at the second arm 24*c* of the active lever 24 to rotate the active lever 24 counterclockwise, and the thus the position of the active lever 24 is determined at the locked position (i.e., the position shown in FIG. 8).

On the other hand, when the unlocking operation is applied to the key cylinder, the idle lever portion 29*b* is rotated counterclockwise by the reverse operation of the locking operation explained above, and the active lever 24 is rotated clockwise by the contact wall 29*b*2. Thus, the position of the active lever 24 is determined at the unlocked position (i.e., the position shown in FIG. 1).

Figure 9:
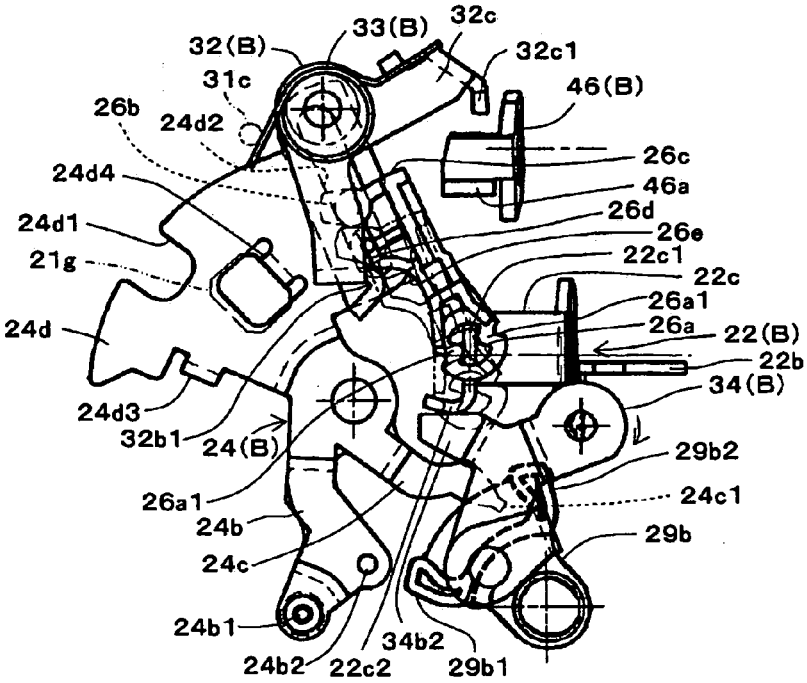
FIG. 9 is a lateral view showing an operational state of each member by operating an inside handle at a locked state of the door lock deice for the vehicle according to the embodiment of the present invention.

A case where an opening operation of the door 2 is performed with the door lock device 4 for the vehicle which is under the locked state and non-operating state of door 2 shown in FIG. 8 will be explained with reference to FIG. 9. When an opening operation of the handle 3 (i.e., the inside handle) is performed in the state shown in FIG. 8, as shown in FIG. 9, the inside lever 34 positioned at the normal position is rotated clockwise and the open lever 22 is rotated against the biasing force of the torsion spring 23, and the tip end portion of the second arm 22*c* moves upward. Accordingly, the open link 26 is pushed upward keeping the tilted state. In those circumstances, because the contact portion 26*c* of the open link 26 does not contact the contact portion 46*a* of the lift lever 46 positioned at the normal position, the lift lever 46 is not rotated. Consequently, the connecting portion 45*a* of the pawl 45 does not rotate. In this case, because the connecting portion 45*a* is not disengaged from the latch 44 in case the connecting portion 45*a* is engaged with the latch 44, the latched state at which the striker 50 and the latch 44 are latched cannot be released.

Further, when an opening operation of the handle 3 (i.e., the outside handle) is performed, the open lever 22 positioned at the normal position is rotated against a biasing force of the torsion spring 23, and the tip end portion of the second arm 22*c* moves upward. Thereafter, an operation likewise the opening operation of the handle 3 (i.e., the inside handle) is performed.

A case where a keyless lock operation is performed with the door lock device 4 for the vehicle which is under the locked state and the non-operating state of door 2 shown in FIG. 8 will be explained with reference to FIG. 10. With the keyless lock operation, the door lock device 4 for the vehicle is operated to be the locked state by a manual operation of the lock knob in a state where the door 2 is open and, thereafter, the door 2 is closed in a state where the opening operation of the handle 3 (i.e., the outside handle) is performed. With the construction of the door lock device 4 for the vehicle, when the opening operation of the handle 3 (i.e., the outside handle) is performed under the locked state, as shown in FIG. 10, the open lever 22 is rotated to push the open link 26 upward keeping the tilted state. Then, when the open link 26 is pushed upward and the recess portion 26*e* of the first side surface 26*d* reaches the contact portion 32*b*1, the cancel lever 32 rotates counterclockwise and the contact portion 32*c*1 of the cancel lever 32 is detached from the contact portion 46*a* of the lift lever 46.

By closing the door 2 in the foregoing state, when the striker 50 and the latch 44 is latched, the pawl 45 is rotated clockwise in FIG. 4 by the latch 44 and the lift lever 46 is rotated in the same direction (i.e., in the arrowed direction in FIG. 10). In this case, because the contact portion 32*c*1 of the cancel lever 32 is positioned detached from the contact portion 46*a* of the lift lever 46, the contact portion 46*a* of the lift lever 46 does not contact the contact portion 32*c*1 of the cancel lever 32 and fans the air. Thereafter, by returning the handle 3 (i.e., the outside handle) under the opening operation state after closing the door 2, the door lock device 4 for the vehicle returns to the state shown in FIG. 9, and the door 2 is closed under the locked state where the latched state of the latch 44 and the striker 50 cannot be released.

Figure 11:
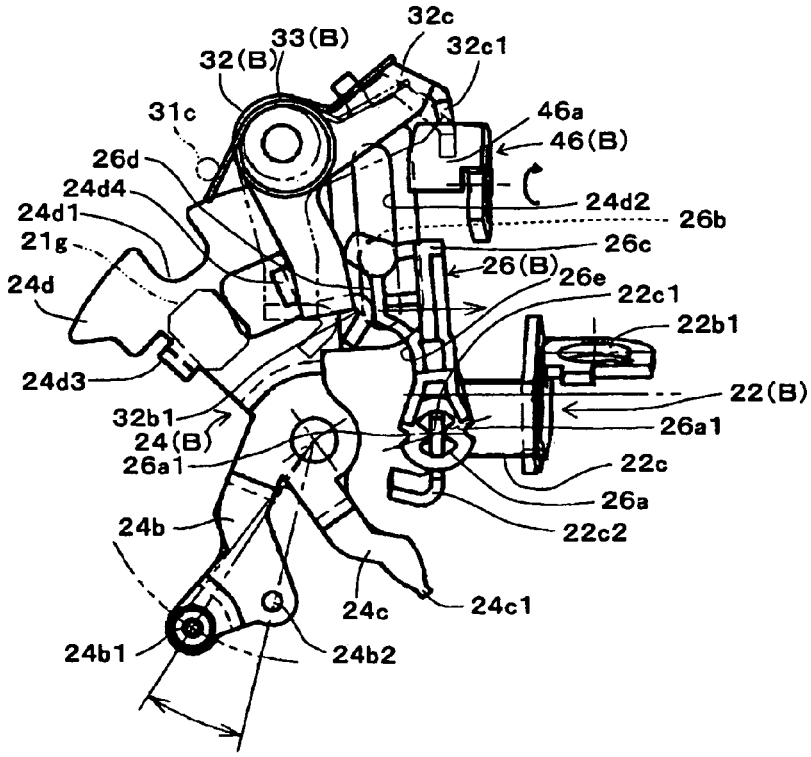
FIG. 11 is a lateral view showing an operational state of each member by canceling operation of the door lock device for the vehicle according to the embodiment of the present invention.

A case where a canceling operation is performed with the door lock device 4 for the vehicle under the locked state shown in FIG. 8 and under non-operating state of door 2 will be explained with reference to FIG. 11. The canceling operation is an operation to release the locked state for closing the open door 2 which is under the locked state without performing opening operation of the handle 3 (i.e., the outside handle). Upon closing the door 2 under the locked state shown in FIG. 8, when the striker 50 and the latch 44 are latched, the pawl 45 is rotated clockwise in FIG. 4 by the latch 44 and the lift lever 46 is rotated in the same direction (i.e., in the arrowed direction shown in FIG. 10). In those circumstances, because the contact portion 32*c*1 of the cancel lever 32 is positioned approaching the contact portion 46*a* of the lift lever 46, the contact portion 46*a* of the lift lever 46 contacts the contact portion 32*c*1 of the cancel lever 32 to push the open link 26 to the right in FIG. 11. Consequently, the state of the open link 26 is changed from the tilted state to the upright state and the active lever 24 is rotated clockwise to be the unlocked state.

As explained above, according to the embodiment of the present invention, the torsion spring 33 biases the contact portion 32*b*1 serving as the first contact end portion of the cancel lever 32 in a predetermined direction, and the contact portion 32*b*1 of the cancel lever 32 constantly contacts the first side surface 26*d* of the open link 26 by the biasing force of the torsion spring 33. By this contact, the cancel lever 32 is constantly connected to the open link 26 without a gap. Thus, when the cancel lever 32 and the open link 26 are operated, a noise is not generated because there is no shakiness between the cancel lever 32 and the open link 26.

Further, because the contact potion 32*b*1 of the cancel lever 32 reciprocates along the first side surface 26*d* of the open link 26 when the cancel lever 32 and the open link 26 are operated, it is not necessary to provide an engaging groove on the open link in order to guide the engaging pint of the cancel lever. Because a portion for forming the engaging groove on the open link is not necessary, the open link 26 is downsized, and thus downsizing and reducing the manufacturing cost of the door lock device 4 for the vehicle can be achieved.

Further, because the members of the operating mechanism B is housed in the housing A and the cancel lever 32 is integrally rotatably provided with the cover 31 which is a part of the housing A, the cover unit 30 can be readily assembled to the housing body unit 20, and thus the door lock device 4 for the vehicle per se can be assembled readily.

Because the torsion spring 33 serves as the biasing means, and the first end 33*a* of the torsion spring 33 is connected to the connecting pin 31*c* serving as the connecting portion provided at the cover 31 of the housing A and the second end of the torsion spring 33 is engaged with the cancel lever 32, the contact portion 32*b*1 of the cancel lever 32 can be readily and securely biased to contact the first side surface 26*d* of the open link 26.

Because the recess portion 26*e* is provided at the first side surface 26*d* of the open link 26 to which the cancel lever 32 contacts and the recess portion 26*e* is formed at the portion to which the contact portion 32*b*1 of the cancel lever 32 contacts under the open state of the handle 3, an opening and/or closing operation of the door handle and the keyless lock operation can be normally functioned.

When an opening operation of the handle 3 (i.e., the outside handle) is performed, the open lever 22 positioned at the normal position is rotated against the biasing force of the torsion spring 23, and the tip end portion of the second arm 22*c* moves upward. Thereafter, the operation likewise the opening operation of the handle 3 (i.e., the inside handle) is performed.

When the lock knob or the key cylinder is operated to unlock the door 2 at the locked state shown in FIG. 8, or when the unlocking operation is performed by the electric motor 27, the active lever 24 is rotated clockwise, and the position of the active lever 24 is determined at the unlocked position shown in FIG. 6 again. Accordingly, by an opening operation of the handle 3 (i.e., the outside or the inside handle), the latched state between the striker 50 and the latch 44 becomes releasable.

In case the open door 2 is closed without performing an opening operation by the handle 3 (i.e., the outside handle) under the locked state of the door lock device 4, the active lever 24 is rotated clockwise by the canceling operation by the cancel lever 32 to be the unlocked state. Namely, during the canceling operation, when the striker 50 and the latch 44 are latched, the pawl 45 is rotated clockwise in FIG. 4 by the latch 44 and the lift lever 46 is rotated in the same direction (i.e., in the direction of arrow C in FIG. 4). In those circumstances, because the contact portion 32*c*1 of the cancel lever 32 is positioned close to the contact portion 46*a* of the lift lever 46, the contact portion 46*a* of the lift lever 46 contacts the contact portion 32*c*1 of the cancel lever 32 to push the open link 26 to the right in FIG. 9. Accordingly, the state of the open link 26 is changed from the tilted state to the upright state, and the active lever 24 is rotated to the unlocked position.

According to the embodiment of the present invention, the elongated bore 24*d*2 is formed at the rotatable active lever 24 side, and the engaging portion 26*b* which engages with the elongated bore 24*d*2 is formed at the slidable open link 26 side. Accordingly, the open link 26 can be downsized, and thus the housing A which houses the operating mechanism B can be downsized.

According to the embodiment of the present invention, the engaging projection (engagement supporting portion) 22*c*1 of the open lever 22 operated by the operation of the handle 3 (i.e., the inside handle or the outside handle) is engaged with the engaging hole 26*a* formed on the first end of the open link 26 is explained. However, the constructions for operating the open link 26 by operating the handle 3 is not limited, and various constructions can be applied as long as the open lever 22 is operatively connected to the handle 3.

According to the embodiment of the present invention, the elongated bore is formed at the active lever which is rotatably supported by the housing, and the engaging portion which slidably engages with the elongated bore is provided at the open link. Because the elongated bore is provided at the active lever which does not slide, the open link can be downsized, and the operational range of the open link can be reduced.

Accordingly, the housing which houses the operating mechanism can be downsized, mountability to a vehicle is improved, and costs for parts can be reduced.

According to the embodiment of the present invention, the open link is configured to have approximately bar shape, the first end of the open link is rotatably engaged and supported by the engagement-supporting portion provided at the open lever operated by the operation of the handles, and the engaging portion which engages with the elongated bore is provided at the second end of the open link. With the construction according to the embodiment of the present invention, the open link can be appropriately operated between the locked position and the unlocked position by the rotation of the active lever and functioning the engagement-supporting portion as the fulcrum.

According to the embodiment of the present invention, because the open link is guided between the active lever and the internal surface of the housing to be movable, sliding guide of the open link can be performed with a simple construction.

According to the embodiment of the present invention, the biasing means biases the first contact end portion of the cancel lever in the predetermined direction, and the first contact potion of the cancel lever constantly contacts the first side surface of the open link by the biasing force of the biasing means. By this contact, the cancel lever is constantly connected to the open link without the clearance. Accordingly, a noise is not generated when the cancel lever and the open link are operated because there is not shakiness between the cancel lever and the open link.

The principles, preferred embodiment and mode of operation of the present invention have been described in the foregoing specification. However, the invention which is intended to be protected is not to be construed as limited to the particular embodiment disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

The invention claimed is:

1. An opening mechanism of a door lock device for a vehicle, comprising:

an active lever operable to selectively establish a locked position where a latched state between a latching means provided at a body of the vehicle and a latched means provided at a door is unreleasable and an unlocked position where the latched state between the latching means and the latched means is releasable;

an open lever operably connected to a handle and operating in response to an operation of the handle;

an open link operably connected to the open lever and the active lever, the open link allowing a transmission of an operational force of the open lever to the latched means when the active lever is at the unlocked position and disabling a transmission of the operational force of the open lever to the latched means when the active lever is at the locked position, the open link including a first side surface and a recess portion;

a lift lever which operates in response to the operation of the open link based on the operation of the handle when the active lever is at the unlocked position to release the latched state of the latched means; and a cancel lever changing a state of the open link from a locked state to an unlocked state by affecting the open link by an operational force from the latched means, the cancel lever having a first contact end portion that is biased by biasing means to contact the first side surface of the open link in a closed state of the handle, having the cancel lever in the moving path of the lift lever and biased to contact the recess portion in an opening state of the handle so that the cancel lever is moved away from the moving path of the lift lever; wherein the active lever comprises an elongated bore;

the open link comprises an engaging portion which engages with the elongated bore to be slidable therein so that the opening mechanism can be downsized compared to an opening mechanism in which the open link comprises the elongated bore; and the elongated bore and the engaging portion are engaged to engage the active lever and the open link.

2. The opening mechanism of the door lock device for the vehicle according to claim 1, wherein the open link is configured approximately in a bar shape, a first end of the open link is rotatably engaged with and supported by an engagement supporting portion provided at an open lever which is operated by operating the handle, and the engaging portion is provided at a second end of the open link.

3. The opening mechanism of the door lock device for the vehicle according to claim 1, wherein the open link is slidably guided between the active lever and an internal surface of the housing.

4. The opening mechanism of the door lock device for the vehicle according to claim 2, wherein the open link is slidably guided between the active lever and an internal surface of the housing.

5. The opening mechanism of the door lock device for the vehicle according to claim 1, wherein the engaging portion of the open link fittingly engages with the elongated bore of the active lever.

6. The opening mechanism of the door lock device for the vehicle according to claim 1, wherein the engaging portion is formed at a top end of the open link.

7. The opening mechanism of the door lock device for the vehicle according to claim 1, the cancel lever is housed in a housing while being integrally attached thereon so as to rotate.

8. The opening mechanism of the door lock device for the vehicle according to claim 7, wherein the biasing means includes a torsion spring, and a first end of the torsion spring is connected to a connecting portion provided at the housing and a second end of the torsion spring is engaged with the cancel lever.

9. The opening mechanism of the door lock device for the vehicle according to claim 1, wherein the biasing means includes a torsion spring, and a first end of the torsion spring is connected to a connecting portion provided at the housing and a second end of the torsion spring is engaged with the cancel lever.

10. An opening mechanism of a door lock device for a vehicle, comprising:

an active lever operable to selectively establish a locked position where a latched state between a latching means provided at a body of the vehicle and a latched means provided at a door is unreleasable and an unlocked position where the latched state between the latching means and the latched means is releasable;

an open lever operably connected to a handle and operating in response to an operation of the handle;

an open link operably connected to the open lever and the active lever, the open link allowing a transmission of an operational force of the open lever to the latched means when the active lever is at the unlocked position and operating in response to the operation of the active lever when the active lever is at the locked position to disable a transmission of the operational force of the open lever to the latched means, the open link including a first side surface and a recess portion;

a lift lever which operates in response to the operation of the open link based on the operation of the handle when the active lever is at the unlocked position to release the latched state of the latched means;

a cancel lever changing a state of the open link from a locked state to an unlocked state by affecting the open link by an operational force from the latched means, a first contact end portion of the cancel lever is moved to contact the first side surface of the open link in a closed state of the handle, having the cancel lever in the moving path of the lift lever, and contacting the recess portion in an opening state of the handle so that the cancel lever is moved away from the moving path of the lift lever; and a biasing means biasing the first contact end portion of the cancel lever to contact the first side surface of the open link.

* * * * *